United States Patent [19]

Pokrinchak

[11] Patent Number: 4,726,461

[45] Date of Patent: Feb. 23, 1988

[54] MODULAR DOCUMENT TURNER AND CONVEYOR

[75] Inventor: Jordan Pokrinchak, Shelton, Conn.

[73] Assignee: Pitney Bowes Inc., Stamford, Conn.

[21] Appl. No.: 887,770

[22] Filed: Jul. 21, 1986

[51] Int. Cl.[4] ..... B65G 47/24

[52] U.S. Cl. ..... 198/412; 198/583

[58] Field of Search ..... 198/412, 414, 457, 583

[56] References Cited

U.S. PATENT DOCUMENTS

| | | | |
|---|---|---|---|
| 1,380,691 | 6/1921 | Tuohy | 198/583 X |
| 4,160,500 | 7/1979 | VerMehren | 198/457 |
| 4,418,515 | 12/1983 | Foster et al. | 53/457 |
| 4,437,560 | 3/1984 | Wolf | 198/457 |
| 4,494,645 | 1/1985 | Hessling et al. | 198/414 |
| 4,591,046 | 5/1986 | Toste, Jr. et al. | 198/457 |

*Primary Examiner*—Stephen J. Novosad
*Assistant Examiner*—William P. Neuder
*Attorney, Agent, or Firm*—Lawrence E. Sklar; David E. Pitchenik; Melvin J. Scolnick

[57] ABSTRACT

In combination, a document turner having dual interfaces at its receiving end oriented perpendicular to each other, each of the interfaces having a projecting tongue, and a document conveyor having a groove at the exit thereof for engagement with either of the projecting tongues and a pair of document conveying belts aligned on either side of the groove.

5 Claims, 3 Drawing Figures

MODULAR DOCUMENT TURNER AND CONVEYOR

BACKGROUND OF THE INVENTION

The instant invention relates to a document turning machine and a document conveying machine. More particularly, the invention is directed to an envelope conveyor which attaches to an envelope turning machine which turns envelopes received seriatim from an inserting machine for the purpose of aligning each envelope preparatory to the envelope being stamped by a mailing machine which may be located at right angles to the inserting machine or in line with the inserting machine.

Until recently, envelope turning devices were marketed which were limited to a specific angle for turning the envelope as it emerged from the inserter. For example, a "conversion unit and turntable", which is factory installed to a customer's order and adapted to a particular inserter, allows the envelopes to be turned 180° for alignment with a suitable mailing machine positioned at a right angle with respect to the inserting machine. Alternatively, there is available a turner which is installed in the field by appropriate service personnel which is limited to turning the envelope 90°, which turner is used in the case of the mailing machine being aligned with the inserting machine. In both cases, i.e. the mailing machine and inserting machine being aligned with each other or at right angles to each other, neither turning apparatus is readily adaptable to being set up in the field for operation in the alternative mode. More specifically, there was no single envelope turner that could operate both with the mailing machine and inserting machine in alignment or at a right angle to each other.

Envelope turners have now been developed which can turn the envelope either 90° or 180° depending upon the alignment of the mailing machine and inserting machine. However, in order for such a turner to operate with an inserting machine, an envelope conveying machine is needed to fit between the inserting machine and envelope turner which can function regardless of whether the mailing machine is in line or at right angles to the inserter. Expressed in different terms, an envelope conveyor which is attached to the envelope turner is needed to permit the envelope turner to be used in either of its two modes, i.e. the entry and exit of the turner in line with each other, or at a right angle to each other.

Accordingly, the instant invention combines a document turner and a document conveyor with coupling features that enable the turner to be used either in line with upstream document handling equipment or at a right angle to upstream document handling equipment.

SUMMARY OF THE INVENTION

The instant invention provides, in combination, a document turner having dual interfaces at its receiving end oriented perpendicular to each other, each of the interfaces having a projecting tongue, and a document conveyor having a groove at the exit thereof for engagement with either of the projecting tongues and a pair of document conveying belts aligned on either side of the groove.

DETAILED DESCRIPTION OF THE PREFERRED EMBODIMENT

Figure 1:
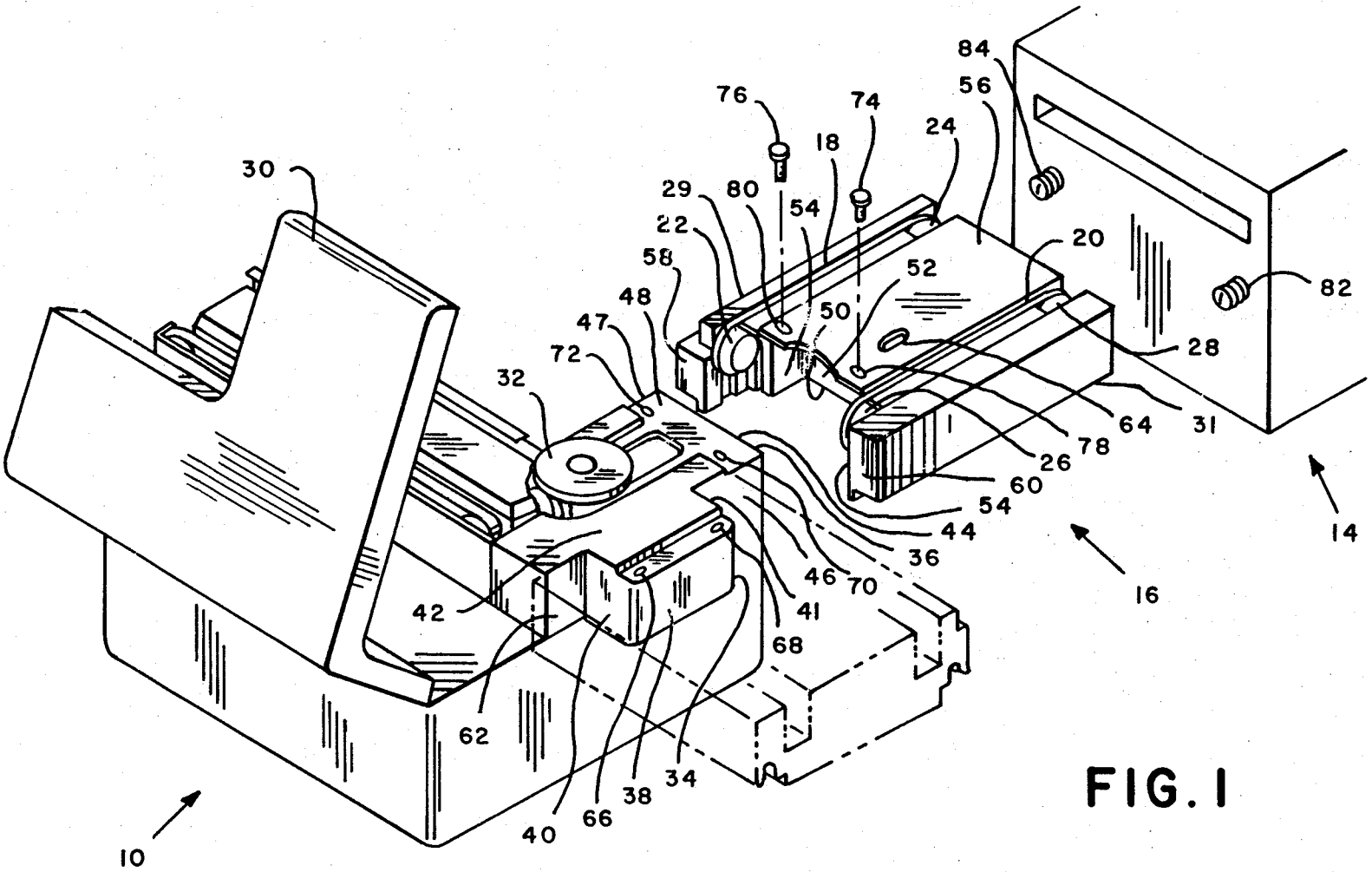
FIG. 1 is a perspective view of an envelope turning machine, a conveying machine and the exit end of an inserting machine in accordance with the instant invention.

In describing the preferred embodiment of the instant invention, reference is made to the drawings, wherein there is seen in FIG. 1 an envelope turning machine generally designated 10 which receives envelopes 12 (see FIGS. 2 and 3) from an inserting machine generally designated 14. The envelopes 12 exit from the inserting machine 14 and are transported to the envelope turner 10 by means of a conveying machine generally designated 16. A pair of O-ring belts (see FIG. 1) 18 and 20 which are mounted on pulleys 22 and 24 and 26 and 28 respectively convey the envelopes from the inserter 16 to the turner 10. The pulleys 22 and 24 are rotatably mounted in housing sidewall 29 of the conveying machine 16 while pulleys 26 and 28 are rotatably mounted in housing sidewall 31 of the conveying machine 16. The four pulleys 22, 24, 26 and 28 are driven by conventional motors (not shown).

The envelope turner 10 includes a hinged, cover member 30 and a clamping disc 32 (see FIG. 1) which turns the envelope through an angle of 90° or 180° (as discussed further hereinbelow) for downstream processing to a mailing machine (not shown) which prints the postage on the envelope 12. The envelope turner 10 includes dual interfaces at its receiving or upstream end. The interfaces are oriented perpendicular to each other and are in the form of projecting tongues 34 and 36, which are identical in width and height and similar in length. The tongue 34 is formed by a front wall 38, a pair of sidewalls 40 and 41 and a stepped top wall 42. The tongue 36 is formed by a front wall 44, a pair of sidewalls 46 and 47, and a stepped top wall 48. The width of the tongue 34, as defined by the distance between the sidewalls 40 and 41 is identical to the width of the tongue 36, as defined by the distance between the sidewalls 46 and 47. Additionally, the turner 10 includes a vertical face 62 adjacent and perpendicular to the sidewall 40.

The envelope conveyor 16 includes a groove 50 defined by a back wall 52, a pair of recessed side segments 54 (only one of which is visible in FIG. 1) and the forward portion of a top wall 56. The width of the groove 50, as defined by the distance between the side segments 54, is virtually identical to the width of the tongues 34 and 36. The conveyor 16 also includes, as discussed hereinabove, the four pulleys 22, 24, 26 and 28.

The pulleys 22 and 26 are situated downstream of the side segments 54 and are spaced from each other at least the same distance as the distance between the side segments 54. Additionally, the pulleys 22 and 26 are mounted in the downstream portion of the housing sidewalls 29 and 31 respectively. The housing sidewalls 29 and 31 include a pair of front, vertical faces 58 and 60 respectively.

As best seen in FIG. 1, the conveying machine 16 includes the top wall or conveying deck 56 in which is seated a photodetector 64 for controlling the sequencing of the clamping disc 32. The belts 18 and 20 are situated on the pulleys 22 and 24, and 26 and 28 respectively such that they are slightly elevated with respect to the top surface of the deck 56.

Figure 2:
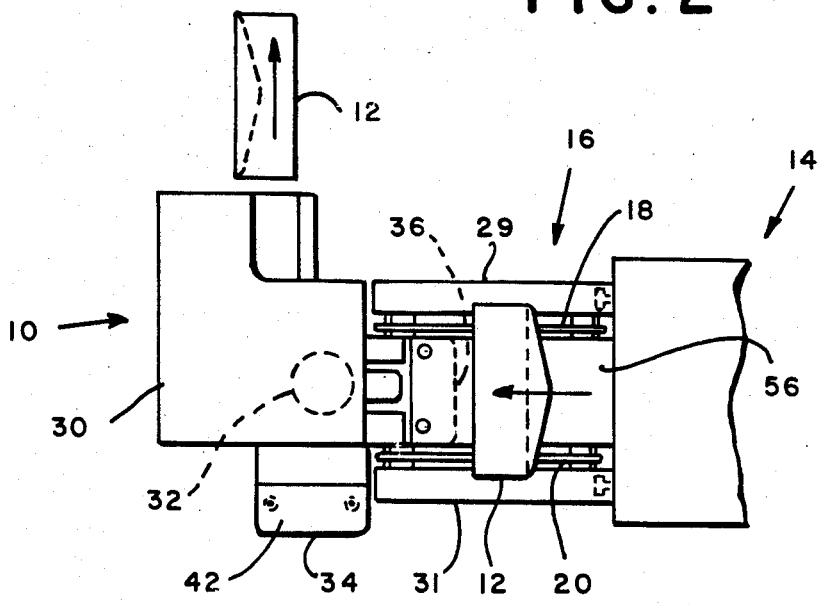
FIG. 2 is a top, plan view of the envelope turner, conveyor and inserter seen in FIG. 1.
Figure 3:
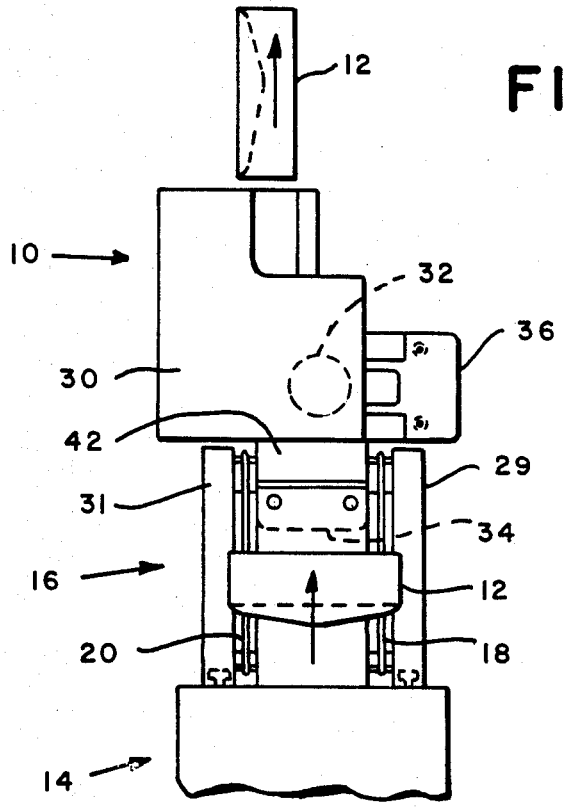
FIG. 3 is the same as FIG. 2, except the inserter is shown in-line with the envelope turner.

In operation, an inserting machine 14 may be situated at right angles to a mailing machine (as seen in FIG. 2) which applies postage to the envelope 12. In such a case, an envelope turner 10 is required to turn the envelope 12 180° in order for the envelope 12 to be properly positioned to receive the postage as printed by a postage metering machine. It is also possible that an inserting machine 14 may be situated in-line to a mailing machine (as seen in FIG. 3), in which case, an envelope turner is required to turn the envelope 12 only 90°. There are envelope turners available which can be programmed for a 90° or a 180° turning of the envelopes 12. The envelope turner tongue 34 includes a pair of threaded apertures 66 and 68 (see FIG. 1) while the envelope turner tongue 36 includes a pair of threaded apertures 70 and 72 which receive a pair of bolts 74 and 76 respectively. The conveyor 16 includes a pair of openings 78 and 80 for receiving the bolts 74 and 76 respectively.

When the envelopes 12 need to be turned 180°, the configuration shown in FIGS. 1 and 2 is employed and the envelope turner tongue 36 is inserted into the conveyor groove 50 such that the recessed side segments 54 are adjacent and almost contiguous with the sidewalls 46 and 47 of the tongue 36 and the backwall 52 of the groove 50 is adjacent the tongue front wall 44. The openings 78 and 80 are aligned with the apertures 70 and 72 respectively and the bolts 74 and 76 are then threadingly engaged with the threaded apertures 70 and 72, resulting in the forward portion of the top wall 56 being situated above and substantially contiguous with the downstream portion of the turner top wall 48.

When the envelopes 12 need to be turned 90°, the configuration shown in FIG. 3 is employed and the envelope turner tongue 34 is inserted into the conveyor groove 50 such that the recessed side segments 54 are adjacent and almost contiguous with the sidewalls 40 and 41 of the tongue 34 and the backwall 52 of the groove 50 is substantially adjacent the tongue front wall 38. The openings 78 and 80 are aligned with the threaded apertures 66 and 68 respectively and the bolts 74 and 76 are then threadingly engaged with the threaded apertures 66 and 68, resulting in the forward portion of the top wall 56 being situated above and substantially contiguous with the downstream portion of the turner top wall 42.

In both of the configurations seen in FIGS. 2 and 3, the conveyor 16 is secured to the inserter 14 by means of a pair of screws 82 and 84. Thus, the conveyor is held firmly in place by virtue of being secured to both the envelope turner 10 and the inserting machine 16.

It is thought that the invention and many of its attendant advantages will be understood from the foregoing description and it will be apparent that various changes may be made in the form, construction and arrangement of the parts without departing from the spirit and scope of the invention or sacrificing all of its material advantages, the form hereinabove described being merely a preferred embodiment thereof.

What is claimed is;

1. In combination, an envelope turner and a document conveyor, said envelope turner having dual interfaces at its receiving end oriented perpendicular to each other, each of said interfaces having a projecting tongue, said document conveyor having a top wall, a groove at the exit thereof for engagement with either of said projecting tongues and a pair of O-ring document conveying belts aligned on either side of said groove, and wherein said projecting tongues include a front wall, a pair of sidewalls perpendicular to said front wall, and a horizontal top wall perpendicular to said front wall and said sidewalls.

2. The combination of claim 1, wherein the width of said tongues are substantially identical.

3. The combination of claim 2, wherein the width of said groove is substantially the same as the width of said tongues.

4. The combination of claim 3, wherein said groove comprises a back wall, a pair of recessed side segments perpendicular to said back wall, and the forward portion of said top wall.

5. The combination of claim 4, wherein the width of said groove is substantially the same as the width of said tongues.

* * * * *